United States Patent [19]

Speckhart

[11] Patent Number: 4,813,729

[45] Date of Patent: Mar. 21, 1989

[54] MAGNETIC RETRIEVAL TOOL

[76] Inventor: Frank H. Speckhart, 534 Dellwood Dr., Knoxville, Tenn. 37919

[21] Appl. No.: 154,968

[22] Filed: Feb. 10, 1988

[51] Int. Cl.[4] ..... H01F 7/20; A63F 9/00; B66C 1/04

[52] U.S. Cl. ..... 294/65.5; 335/285; 335/302

[58] Field of Search ..... 294/65.5; 273/1 M, 148 R, 273/239, 269; 335/285, 293, 294, 302, 286

[56] References Cited

U.S. PATENT DOCUMENTS

| | | | |
|---|---|---|---|
| 1,521,173 | 12/1924 | Catching . | |
| 2,428,864 | 10/1947 | Boyd | 294/65.5 |
| 2,683,618 | 7/1954 | Long | 294/65.5 |
| 2,693,979 | 11/1954 | Russell | 294/65.5 |
| 3,169,791 | 2/1965 | Twachtman | 294/65.5 |
| 3,223,898 | 12/1965 | Bey | 317/159 |
| 3,452,310 | 6/1969 | Israelson | 335/286 |
| 3,477,050 | 11/1969 | Hinger | 294/65.5 |
| 3,771,084 | 11/1973 | Thon | 335/285 |
| 4,649,116 | 3/1987 | Daty et al. | 294/65.5 |

*Primary Examiner*—James B. Marbert

*Attorney, Agent, or Firm*—Luedeka, Hodges & Neely

[57] ABSTRACT

A magnetic retrieval tool for retrieving magnetically attractable objects includes a magnet supported in a magnet housing on an elongated, flexible shaft. The magnet is positioned adjacent a face of the housing and is oriented with a line extending through the N and S poles being generally parallel to the face with pole pieces concentrating the magnetic force of the magnet at the face. A remotely operated force reduction feature includes a sleeve of a magnetically attractable material movable between a first position with at least a portion of said magnet disposed within the sleeve to reduce the magnetic forces of the magnet and a second position with the sleeve remote from said magnet.

14 Claims, 1 Drawing Sheet

MAGNETIC RETRIEVAL TOOL

The present invention relates to a magnetic retrieval tool and to a magnetic retrieval tool which selectively reduces the magnetic force of the magnet so that the tool can be easily maneuvered into tight places surrounded by magnetically attractable parts.

Various magnetic pick-up devices for magnetically attractable items are known which include a flexible shaft for manipulating a magnet on the end of the shaft into an area which is otherwise inaccessible. In many of such devices, the magnet employed is of small size for accessing small areas but is of insufficient strength to retrieve the desired item. In addition, such devices are often needed in tight places surrounded by metal parts which are also magnetically attractable. Consequently, it is difficult to control the positioning of the magnet in such environments particularly since the flexible shaft enables the magnet to be drawn towards such surrounding metal parts.

Various magnetic devices are known for varying the strength of a magnet and include compound magnet systems where the relative orientation of two or more magnets is adjusted to adjust the magnetic force. In addition, magnetic tools are known where the distance between a magnet and a working face is adjusted to decrease the magnetic force applied at the face. However, these types of devices often do not provide sufficient magnetic force and do not substantially decrease the lateral magnetic attraction towards surrounding magnetically attractable materials.

Accordingly, a need has arisen for a magnetic retrieval tool having enhanced magnetic strength and compact size. A need has also arisen for a magnetic retrieval tool having the capability for selectively reducing its magnetic strength to facilitate use adjacent to magnetically attractable materials.

In accordance with one form of the invention, a magnetic retrieval tool is provided which includes a high strength permanent magnet having N and S poles and pole pieces in contact with the magnet generally adjacent the N and S poles. A magnet housing provides a face which is generally perpendicular to a line extending between the N and S poles of the magnet. The retrieval tool further includes an elongated flexible shaft attached to the housing remote from the face.

In accordance with another form of the present invention, there is provided a magnetic retrieval tool for magnetically attractable objects including a magnet, an elongated, flexible shaft having a first end and a second end, a magnet housing attached to the first end of the flexible shaft and supporting the magnet at a position remote from the shaft. The tool includes a force reduction mechanism including a sleeve provided within the housing for selectively reducing the magnetic forces of the magnet. The sleeve defines an interior area and is movable to the first position where a portion of the magnet is disposed within the interior area and a second position where the sleeve is remote from the magnet. An actuator is provided at the second end of the flexible shaft and is operably connected to the sleeve for selectively moving the sleeve between the first and second positions.

In accordance with a more particular form of the present invention, the magnet housing defines a generally cylindrical chamber within the housing and the sleeve is a generally cylindrical tube slidably fitted within the chamber. In accordance with a preferred form of the invention, the sleeve includes a top plate substantially closing one end of the tubular sleeve, the tubular sleeve being dimensioned so that the top plate contacts the magnet when the tubular sleeve is in the first position.

The present invention may best be understood by reference to the following detailed description when considered in conjunction with the accompanied drawings in which.

Figure 1:
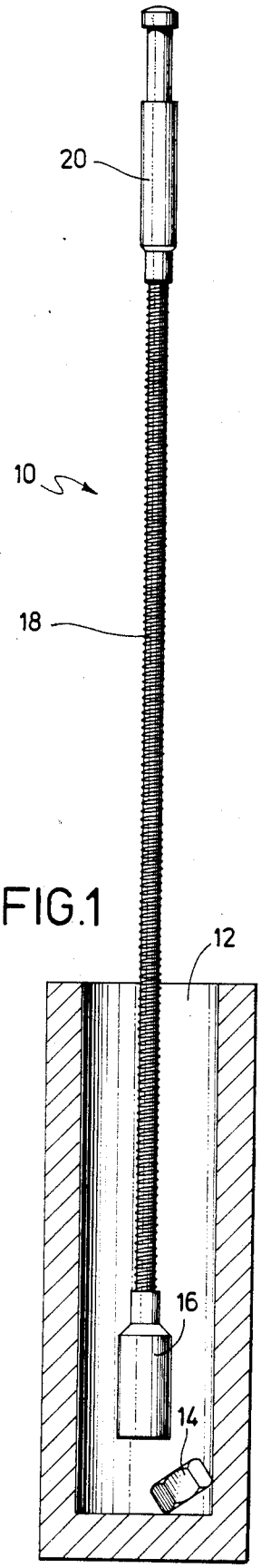
FIG. 1 is an elevational view of a preferred embodiment of the present invention shown being inserted into a recess to pick up a nut.

Referring now to the drawings in which like reference characters designate like or corresponding parts throughout the several views, there is shown in FIG. 1 a magnetic retrieval tool 10 in accordance with the present invention. The tool 10 is shown being inserted into a recessed area 12 to retrieve a nut 14. As will be explained in more detail, the magnetic retrieval tool 10 includes a magnet housing 16 which is maneuvered by means of a flexible shaft 18 and handle 20.

Figure 2:
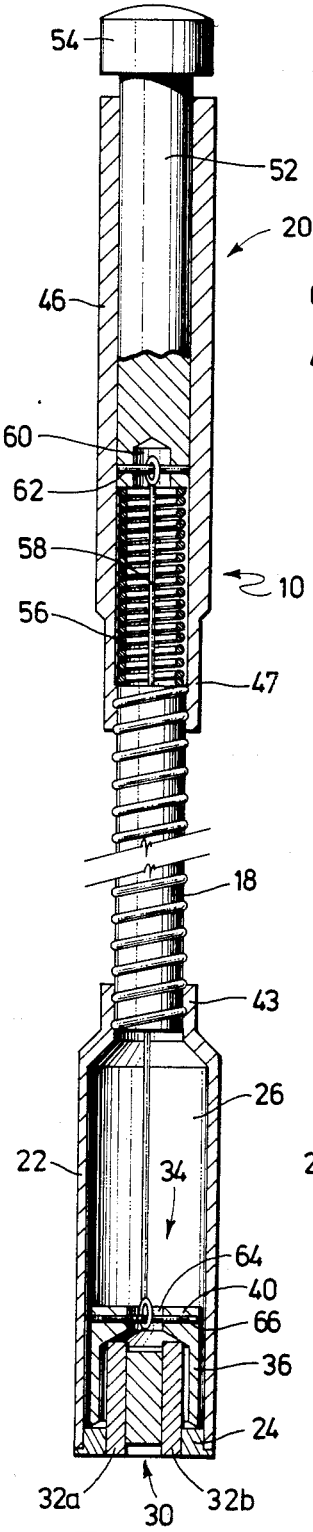
FIG. 2 is an enlarged partially cross-sectional partial view of the apparatus of FIG. 1 shown in a configuration which reduces the magnetic forces.
Figure 3:
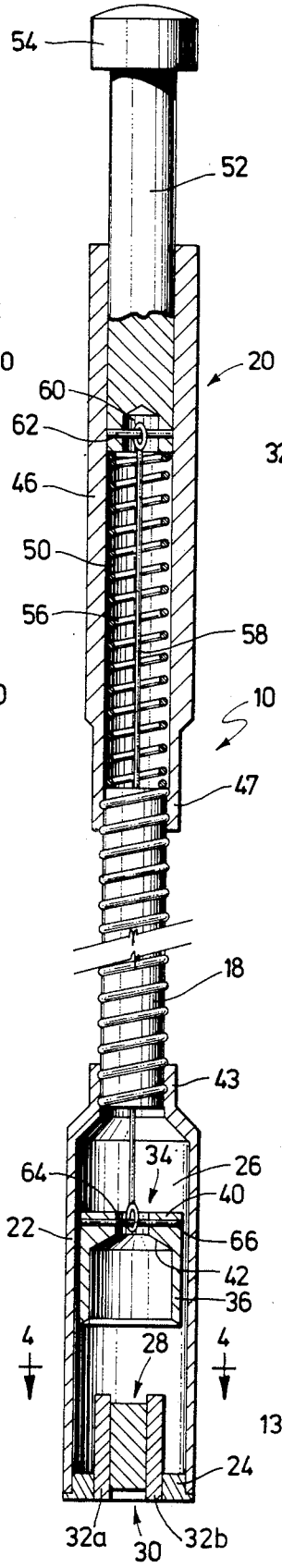
FIG. 3 shows the magnetic retrieval tool of FIG. 1 shown with the magnetic force reduction feature shown deactivated.

Referring now to FIGS. 2 and 3, the construction of the magnetic retrieval tool 10 according to the present invention is shown in more detail. In the preferred embodiment of the invention illustrated, the magnet housing is provided by a cylindrical tube 22 of a non-magnetic material such as aluminum which is enclosed at one end by end cap 24, also preferably fabricated of a non-magnetic material such as aluminum. The cylindrical tube 22 provides a cylindrical chamber 26 within the cylindrical tube 22, one end of which is closed by end cap 24. A magnet 28 is provided in the cylindrical chamber 26 adjacent end cap 24 and thus a face 30 at the end of the cylindrical tube 22 is provided on the magnetic retrieval tool 10.

The inside and outside diameters of the cylindrical tube 22 are determined by the size of the magnet and the size of the areas to be reached with the tool 10. Thin wall aluminum tubing having an outside diameter of about 1.5 cm is particularly suitable for many applications.

Figure 4:
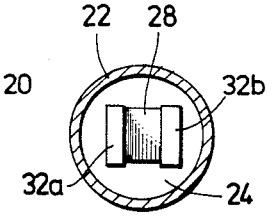
FIG. 4 is a cross-sectional view of the tool of FIG. 1 taken along line 4—4 of FIG. 3.

The magnet 28 employed in the preferred magnetic retrieval tool 10 is a high strength permanent magnet with its poles oriented along a line parallel to the plane of the face 30. The preferred configuration is a rectangular prism as illustrated. Pole pieces **32*a* and 32*b*, such as the rectangularly shaped soft steel pole pieces illustrated, contact the magnet generally at its poles and concentrate the flux lines between the pole pieces and thus present a concentrated magnetic flux at the face 30. Preferably, edges of the pole pieces 32*a* and 32*b* are aligned with the face 30. The magnet 28 and pole pieces 32*a* and 32*b* are provided in a centrally disposed generally rectangular recess in the end cap 24 as illustrated in FIG. 4 and are secured by suitable means such as gluing so that the pole pieces 32*a* and 32*b* are generally flush with the face 30 provided by the end cap 24**.

The preferred magnets for use in the tool 10 of the present invention are strong permanent magnets such as neodymium-iron-boron permanent magnets which have high magnetic strength and thus can be employed in various small sizes. A suitable rectangular prism magnet of this type has the dimensions of about 1 cm×0.5 cm×0.3 cm with the poles being located on the 1 cm×0.5 cm faces. Similarly dimensioned pole pieces with a thickness of 0.2 cm are employed to contact the magnet at the poles. Employing a magnet of this type enables the cylindrical tube 22 to have an outside diameter of 1.5 cm or less. Suitable neodymium-iron-boron permanent magnets are available from Hitachi Magnetics Corporation, Edmore, Mich., 48829, under the trademark "HICOREX½-ND" or from I G Technologies, Valpariaso, Ind. 46383, under the trademark "NeIGT½."

The magnetic retrieval tool 10 shown in FIGS. 1–4 includes a magnetic force reduction mechanism designated generally by the numeral 34. The magnetic force reduction mechanism 34 includes a magnetic force reduction sleeve 36 having an interior area for receiving at least a portion of the magnetic 28 to reduce the magnetic force applied by the magnet particularly in the lateral directions. In the preferred tool 10 illustrated, the sleeve 36 is produced from a magnetically attracted material which is not easily magnetized such as soft steel. Preferably, the sleeve as a cylindrical tubular configuration and is dimensioned to slidingly fit with the cylindrical chamber 26 of the magnet housing 16.

As illustrated in FIGS. 2 and 3, the sleeve is preferably provided with a top plate 40 which substantially closes off the upper end of the sleeve 36 and contacts the pole pieces 32*a* and 32*b* of the magnet 28. As illustrated, the sleeve is thus dimensioned so that when the sleeve receives magnet 28 into its interior area, the sleeve is not prevented by contact with the end cap 24 from providing contact of the top plate 40 with the pole pieces 32*a* and 32*b* of the magnet 28. In order to facilitate the pulling away of the magnet from the top plate 40, a beveled surface 42 is provided so that only the edge of the rectangular pole pieces 32*a* and 32*b* contact the beveled surface 42.

The magnet housing 16 is connected to the flexible shaft at a reduced diameter area 43. The reduced diameter area 43 is attached to the flexible shaft 18 by swaging to further reduce the diameter or by other suitable means. The flexible shaft 18 is suitably provided by flexible tubing such as flexible tubing of coiled construction having an outside diameter of about 0.8 cm. A practical length for the flexible tube is dependent upon the desired application and can typically range between 10 and 60 cm.

At the end of the flexible shaft 18 remote from the magnet housing 16, the handle 20 includes a plunger housing 46 which is attached to the flexible shaft at a reduced diameter area 47 such as by swaging. The plunger housing 46 provides a generally cylindrical bore generally in alignment with the flexible shaft 18. A plunger 52 is slidingly fitted in the plunger housing 46 in the bore 50 and includes a actuation button 54 on the portion of the plunger 52 which extends out of the bore 50. A spring 56 is also provided in the bore 50 and contacts the end of the flexible shaft 18 and the end of the plunger 52 and acts to urge the plunger outwardly from the bore 50. As illustrated, a connecting wire 58 having loops at each end extends between the top plate 40 of the magnetic force reduction sleeve 36 and the lower end of the plunger 52. Thus, the connecting wire extends through the entire length of the flexible shaft 18 and extends through the interior area of the spring 56. The plunger is provided with a recess 60 at its lower end for receiving the looped end of the connecting wire 58 and a pin 62 secures the looped end in the recess 60. Similarly, a bore 64 is provided in the top plate 40 of the sleeve 36 for receiving the opposite looped end of the connecting wire 58 and a pin 66 extends across the bore 64 secures the wire in the bore.

Figure 5:
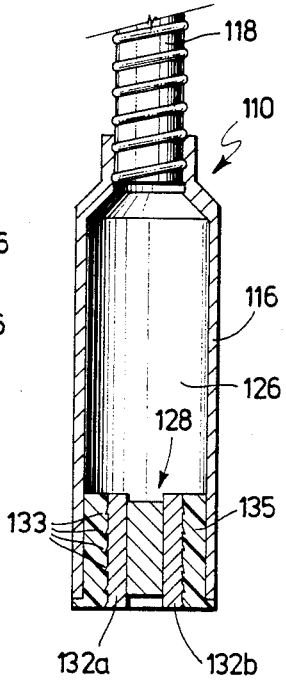
FIG. 5 is a partial cross-sectional view of another preferred embodiment of the invention.

Referring now to FIG. 5 which illustrates an alternate magnetic retrieval tool 110 in accordance with the invention, it will be understood that the tool 110 is similar to the tool 10 illustrated in FIGS. 1–4. The tool illustrated in FIG. 5, however, does not include a force reduction mechanism 34. The tool 110 includes a flexible shaft 18 with an appropriate handle for accessing remote locations. A magnet housing 116 generally corresponds with the magnet housing 16 of the previously described embodiment and provides a chamber 126. However, for this configuration the housing 116 can be square or rectangular to more effectively use the volume of the magnet and pole pieces 132*a* and 132*b*.

A magnet 128 is provided in the tool 110 similarly to the previously described magnet 28. However, it is most preferabl for the pole pieces 132*a* and 132*b* to be provided with barbs 133 which are employed to secure the magnet 128 to the housing or the pole pieces can be attached with an adhesive. Instead of an end cap 24, an injected molded plastic magnet support fitting 135 is dimensioned to snugly insert within the chamber 126 of the magnet housing 116. A generally rectangular cavity is provided in the fitting 135 to snugly receive the magnet with pole pieces positioned on either side and the barbs 133 permit the magnet and pole pieces to be inserted into the cavity but does not permit withdrawal. Adhesive can also be used to secure the magnet and pole pieces.

In operation of the tool 10 illustrated in FIGS. 1–4, the spring 56 acting on plunger 52 and through connecting wire 58, serves to bias the magnetic force reduction sleeve 36 into a position where it is remote from the magnet 28 as shown in FIG. 3. Thus, the tool 10 is provided with the full strength of the magnet 28 in its normal configuration. For maneuvering the tool in an environment as is illustrated in FIG. 1, the plunger 52 is employed to change the tool to the configuration shown in FIG. 2. When the plunger 52 is urged into the bore 50, the wire moves the sleeve 36 toward the magnet 28. The magnet, of course, attracts the sleeve 36 and assists in moving the sleeve 36 to the position of FIG. 2. When the plunger 52 is fully depressed, the sleeve 36 surrounds the magnet 28 and the top plate 40 of the sleeve 36 contacts the pole pieces 32*a* and 32*b* of the magnet 28. Since the magnet is encircled within the sleeve 36 and the top plate connects between the two pole pieces, the magnetic force particularly in lateral directions is significantly reduced. The tool is thus easily maneuverable in environments such as the environment illustrated in FIG. 1. Once the tool is properly positioned with the face 30 adjacent the item to be picked up, the plunger is released. The spring 56 acting on plunger 52 through the connecting wire returns the magnetic force reduction sleeve to a position remote from the magnet 28. The full magnetic strength of the magnet 28 is available for picking up the item. The embodiment illustrated in FIG. 5 is provided with the full magnetic strength at all times and is used similarly.

The magnetic retrieval tool 10 in accordance with the present invention has a compact size yet provides an extremely strong magnetic device for retrieving items. Because of the magnetic force reduction capability of the embodiment 10, the strong magnetic force can be easily maneuvered until it is necessary for use in actually picking up the item. Moreover, these features are provided in a tool which can be of durable, simple, and inexpensive construction.

While preferred embodiments of the present invention have been shown and described in the foregoing detailed description, it will be understood that there is no intent to limit the invention by such disclosure but instead it is intended to cover all modifications and alternate constructions falling within the spirit and scope of the invention as set forth in the appended claims.

What is claimed is:

1. A magnetic retrieval tool for magnetically attractable objects comprising:

a strong permanent magnet of elongated shape so as to define two opposite ends thereof and side faces extending between the magnet ends, said magnet having N and S poles along the side faces of the magnet;

elongated pole pieces secured in contact with the side faces of said magnet on opposite sides thereof and which extend generally between the opposite ends of said magnet;

a magnet housing providing an end face and supporting said magnet adjacent said end face so that a line extending through the N and S poles is oriented generally parallel to the end face, and said pole pieces being operable to reduce the magnetic attraction of said side faces and of said magnet to concentrate the magnetic force at said end face; and an elongated flexible shaft attached to said magnet housing at a position remote from said face.

2. The magnetic retrieval tool of claim 1 in which said magnet housing comprises a tube providing an interior chamber and fitting means for supporting said magnet in said chamber and in a fixed relationship with said tube and so that the longitudinal axes of said pole pieces are oriented generally perpendicular to said end face.

3. The magnetic retrieval tool of claim 2 wherein said magnet and said pole pieces generally have a rectangular prism configuration with said pole pieces being arranged on either side of the magnet at its poles, said fitting means comprising a plastic fitting having a generally rectangular recess to snugly receive said magnet and pole pieces, said pole pieces having barbs configured to secure said magnet and pole pieces within said fitting.

4. A magnetic retrieval tool for magnetically attractable objects comprising:

a magnet;

an elongated flexible shaft having a first end and a second end;

a magnet housing attached to said second end of said flexible shaft and supporting said magnet at a position remote from said shaft;

force reduction sleeve means within said housing for selectively reducing the magnetic forces of said magnet, said sleeve means defining an interior area and being movable to a first position where at least a portion of said magnet is disposed within said interior area and a second position where said sleeve means is remote from said magnet; and actuation means operable from at said second end of said flexible shaft for selectively moving said sleeve means between said first and second positions.

5. The magnetic retrieval tool of claim 4 wherein said actuation means biases said sleeve into said second position remote from said magnet.

6. The magnetic retrieval tool of claim 5 wherein said actuation means comprises a plunger housing attached to said second end of said shaft and defining a plunger bore generally aligned with the orientation of said shaft and a plunger slidably movable in said plunger bore and being operatively connected to said sleeve means.

7. The magnetic retrieval tool of claim 4 wherein said sleeve means is a generally tubular sleeve and is slidably fitted within a generally cylindrical chamber within said housing.

8. The magnetic retrieval tool of claim 7 wherein said sleeve means further comprises a top plate substantially closing one end of said tubular sleeve, said tubular sleeve being dimensioned so that said top plate contacts said magnet when said tubular sleeve is in said first position.

9. The magnetic retrieval tool of claim 8 wherein said magnet housing provides a face with said magnet being provided adjacent said face and said magnet is a permanent magnet oriented so that a line extending through its N and S poles is generally parallel to the face, said magnet having pole pieces contacting said magnet generally adjacent said poles, said top plate of said sleeve contacting said pole pieces when in said first position.

10. The magnetic retrieval tool of claim 9 wherein said magnet is a strong permanent magnet.

11. The magnetic retrieval tool of claim 9 wherein said magnet housing is a generally cylindrical tube of a non-magnetic material generally aligned with said flexible shaft and having an end cap closing an end of said tube remote from said flexible shaft to provide said face, said end cap supporting said magnet in a central portion thereof.

12. The magnetic retrieval tool of claim 5 wherein said flexible shaft comprises an elongated flexible tube and said actuation means comprises a wire extending within said tube between said plunger and said sleeve.

13. A magnetic retrieval tool comprising:

a strong permanent magnet having N and S poles and pole pieces in contact with said magnet generally at said N and S poles;

a generally cylindrical, tubular magnet housing of a non-magnetic material generally enclosing said magnet and pole pieces within a cylindrical chamber, said housing having an end cap at a first end thereof for enclosing said first end to provide a face, said end cap supporting said magnet with said pole pieces generally aligned with said face;

a generally cylindrical tubular sleeve of a magnetically attractable material fitted for movement within said cylindrical chamber of said housing, said sleeve having an interior area receiving said magnet therein when said sleeve is in a first position for reducing the magnetic forces of the magnet and a second position where said sleeve is remote from said magnet;

an elongated flexible tubular shaft having first and second ends with said first end attached to said second end of said magnet housing remote from said face;

a plunger housing attached to said second end of said elongated flexible tubular shaft, said plunger housing having a generally cylindrical bore generally aligned with and remote from said flexible shaft;

a plunger slidably fitted within and having a portion extending out of said cylindrical bore;

a spring provided within said cylindrical bore acting to urge said plunger out of said bore; and a wire connected between said sleeve and said plunger so that said urging said plunger into said cylindrical bore causes said sleeve to be selectively moved to said first position and said spring normally biases said sleeve into said second position.

14. The magnetic retrieval tool of claim 13 wherein said sleeve comprises a top plate enclosed one end of said sleeve and said sleeve being dimensioned so that said top plate contacts said pole pieces when in said first position.

* * * * *